United States Patent [19]

Shibahara et al.

[11] Patent Number: 4,728,602

[45] Date of Patent: Mar. 1, 1988

[54] LIGHT-SENSITIVE SILVER HALIDE EMULSIONS

[75] Inventors: Yoshihiko Shibahara; Shingo Ishimaru; Jun Okuda, all of Kanagawa, Japan

[73] Assignee: Fuji Photo Film Co., Ltd., Kanagawa, Japan

[21] Appl. No.: 918,672

[22] Filed: Oct. 7, 1986

Related U.S. Application Data

[63] Continuation of Ser. No. 686,969, Dec. 28, 1984, abandoned.

[30] Foreign Application Priority Data

Dec. 29, 1983 [JP] Japan ..... 58-248473

[51] Int. Cl.[4] ..... G03C 1/02

[52] U.S. Cl. ..... 430/567; 430/569

[58] Field of Search ..... 430/567, 569

[56] References Cited

U.S. PATENT DOCUMENTS 3,695,888 10/1972 Hiller et al. ..... 430/614
3,761,276 9/1923 Evans ..... 430/567
4,433,048 2/1984 Solberg et al. ..... 430/567
4,477,564 10/1984 Cellone et al. ..... 430/567
4,504,570 3/1985 Evans et al. ..... 430/567
4,514,491 4/1985 Koitabashi et al. ..... 430/567

FOREIGN PATENT DOCUMENTS 2095853 10/1982 United Kingdom ..... 430/567

*Primary Examiner*—Won H. Louie
*Attorney, Agent, or Firm*—Sughrue, Mion, Zinn, Macpeak, and Seas

[57] ABSTRACT

A light-sensitive silver iodobromide emulsion containing core/shell silver iodobromide grains having a core substantially comprising silver iodobromide containing at least about 5 mol % of silver iodide and a shell selected from the group consisting of (a) a shell comprising silver iodobromide having a lower silver iodide content than that of the silver iodobromide of the core and (b) a shell comprising silver bromide, wherein the relative standard deviation of the silver iodide content of the individual grains of said silver halide emulsion is lower than about 20%.

15 Claims, 3 Drawing Figures

LIGHT-SENSITIVE SILVER HALIDE EMULSIONS

This is a continuation of application Ser. No. 686,969, filed 12/28/84, now abandoned.

FIELD OF THE INVENTION

This invention relates to silver halide emulsions, and more particularly to light-sensitive silver halide emulsions having improved sensitivity, contrast, and graininess.

BACKGROUND OF THE INVENTION

Recently, photographic silver halide emulsions have been required having improved photographic properties including high sensitivity, high contrast and excellent graininess.

It is known that for attaining good photographic properties such as high sensitivity, high contrast and excellent graininess, mono-dispersed silver halide emulsions having a narrow grain size distribution as described in, for example, U.S. Pat. No. 4,184,877 corresponding to Japanese Patent Application (OPI) No. 153428/77 are advantageous (The term "OPI" as used herein refers to a "published unexamined Japanese patent application"). It is also useful to increase the utilization efficiency of incident light by using core/shell type silver halide emulsion grains having a silver halide phase of a different composition in the inside of the emulsion grain so that the functions involved in the procedure of from the receipt of light to the image formation can be shared by the core portion and the shell portion of the emulsion grain as completely as possible such that the core portion can catch positive holes to prevent them from combining with photoelectrons, thereby inhibiting the development and preventing the deterioration of graininess, while the shell portion can concentrate photoelectrons therein and form latent images (silver nuclei) efficiently, as described in, for example, *Research Disclosure* 163 p.45–46 (November 1977), *J. Photo. Sci.* 26 p.189 (1978), U.S. Pat. Nos. 3,317,322, 3,850,637 and 3,206,313, *Research Disclosure* 108 p.4 (April 1973) and ibid. 113 p.57 (September 1973), and *Phot. Sci. & Eng.* 19 p.344(1975).

Furthermore, in order to obtain silver halide emulsions of high contrast it is preferred to narrow the distribution of the silver halide composition between silver grains.

In order to evaluate the distribution of the halogen composition of silver halide grains, the known powder X-ray diffraction method described in, for example, U.S. Pat. No. 4,349,622 corresponding to Japanese Patent Application (OPI) NO. 110926/81 can be used. However, since the method is insufficient in resolving power, it is difficult to evaluate the distribution of the halogen composition between silver halide grains. Also, since the distribution of the halogen composition between individual silver halide grains cannot be distinguished from the general distribution of the halogen composition in the silver halide grains using this method, it is impossible to evaluate the distribution of the halogen composition between silver halide grains having the particular distribution of halogen composition required in the core/shell type silver halide emulsions for use in this invention. Therefore, although silver halide emulsions having a controlled distribution of halogen composition in the inside of silver halide grains by mono-dispersing the grain size distribution of the grains in the emulsion have widely been investigated, it is actually impossible to prepare silver halide emulsions meeting such practical requirements of narrow distribution of the halogen composition between silver halide grains. Practical methods of preparing such silver halide emulsions have not yet been disclosed.

The inventors have measured the halogen composition of individual grains of a silver iodobromide emulsion using an X-ray microanalizer and have established that there is a large discrepancy in the halogen composition of individual silver halide grains, which reduces the photographic properties.

SUMMARY OF THE INVENTION

The object of this invention is to provide silver halide emulsions having high sensitivity, high contrast and excellent graininess.

It has now been discovered that silver halide emulsions having very high sensitivity, high contrast and excellent graininess can be obtained by reducing the relative standard deviation of the silver iodide content of individual silver iodobromide grains to a level lower than about 20%.

That is, according to this invention, there is provided a light-sensitive silver iodobromide emulsion containing silver iodobromide grains composed of a core substantially comprising silver iodobromide containing at least about 5 mol% of silver iodide, and a shell substantially comprising silver iodobromide having a lower silver iodode content than the silver iodobromide content of the core or a shell substantially comprising silver bromide, wherein the relative standard deviation of the silver iodide content of the individual grains of said silver halide emulsion is lower than about 20%.

DETAILED DESCRIPTION OF THE INVENTION

Figure 1:
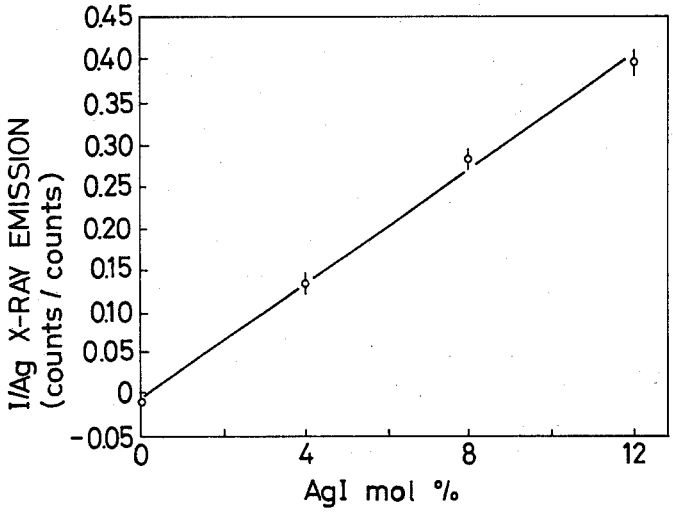
FIG. 1 is a graph showing a calibrtion curve for measuring the silver iodide content of silver iodobromide grains by an X-ray microanalyzer.

In the light-sensitive silver halide emulsions of this invetion, the core of the silver iodobromide grains is substantially composed of silver iodobromide containing at least about 5 mol%, preferably 10 to 45 mol% and more preferably 20 to 45 mol% of silver iodide, and the shell covering the core is substantially composed of silver iodobromide having a lower silver iodide content than the silver iodobromide content of the core or a shell substantially comprising silver bromide. The core may contain homogeneous silver iodobromide or may have a multilayer structure with each layer being composed of a phase having a different silver iodide content. In the latter case, the silver iodide content of the phase having the highest content of silver iodide is at least about 5 mole%, preferably 10 to 45 mol% and more preferably 20 to 45 mol%, and the silver iodide content of the shell is lower than that of the highest silver iodide content phase of the core. The terms "substantially comprising silver iodide" and "substantially comprising silver iodobromide" mean that the silver halide grains are mainly composed of silver iodide and iodobromide, respectively, but may contain less than about 1 mol% of other silver halides than silver iodide and iodobromide, respectively.

A preferred embodiment of the core/shell type silver halide emulsion of this invention contains silver halide grains exhibiting two diffraction maximums, one being the diffraction peak corresponding to the core portion and the other being the diffraction peak corresponding to the shell portion, and one minimum peak between the two peaks, in which the diffraction strength corresponding to the core portion is about 1/10 to 3/1 of that of the shell portion, when the curve of diffraction strength to diffraction angle of the (220) plane of the silver halide is obtained using the K$\beta$ line of Cu in the diffraction angle ($2\theta$) range of 38° to 42°.

In a particularly preferred embodiment of this invention, the diffraction strength ratio is about 1/5 to 3/1, and more particularly about $\frac{1}{3}$ to 3/1.

In an emulsion containing grains having the core/-shell structure described above, the silver iodide content at the surface of the emulsion grains measured using an X-ray photoelectric spectrograph (XPS) is lower than the mean silver iodide content of the emulsion grains measured by, for example, a fluorescent X-ray method. Also, when emulsion grains having the foregoing core/shell structure are, measured by a powder X-ray diffraction method using the K line of Cu, two diffraction peaks of the index of plane (220) of the silver iodobromide crystals or silver bromide crystals generally appear, or if only one diffraction peak appears, the half value width of the peak is larger than $\Delta 2\theta = 0.2°$.

There is fundamentally no restriction of grain size distribution of the silver halide emulsion of this invention, but it is preferred that the emulsion be a mono-dispersed type emulsion. The term "mono-dispersion" means that at least about 95% of the emulsion grains have grain sizes within ±40% of the mean grain size by weight or grain number. Also, while there is no restriction of crystal habit, a normal crystal is more preferred than a twin crystal.

In another preferred embodiment of this invention, the relative standard deviation of the silver iodide content of individual grains of the silver iodobromide emulsion is less than about 20%, more preferably less than about 12% and most preferably 0 to 8%. The silver iodide content of individual emulsion grains can be measured by analyzing the composition of individual grains. By the term "the relative standard deviation of the silver iodide content of individual grains" is meant a value obtained by dividing the standard deviation of the silver iodide content obtained by measuring the silver halide content of at least 100 emulsion grains (for example, using an X-ray micronalayzer) by the means silver iodide content and multiplying by 100.

A practical method of measuring the silver iodide content of the individual grains is as follows. First, a sample emulsion is diluted to five times its volume with distilled water and after adding a proteolytic enzyme such as pronase, the mixture is maintained at 40° C. for 3 hours to decompose the gelatin. Then, the sample is subjected to centrifugal separation to sediment the emulsion grains and after removing the supernatant, the emulsion grains are re-dispersed in distilled water. After repeating the washing procedure twice, the sample is dispersed on a sample table. After drying, carbon is vapor-deposited on the sample grains and then the sample is measured by an ordinary commercially available X-ray micronanalyzer, such as the X-ray microanalyzer EMX-SM, made by Shimazu Corporation used in our experiments. The measurement is made by irradiating the grains with electrons and measuring the characteristic X-ray intensity of each element inthe grain excited by the electrons using a long wavelength dispersion type X-ray detector. The spectral crystals used for the analysis of each element and the wavelength of the characteristic X-ray of each element are shown in Table 1. For determining the silver iodide content of the emulsion grains from the characteristic X-ray intensity of each element, the same measurement is performed on emulsion grains of known silver iodide content to prepare a calibration curve as shown in FIG. 1, and the silver iodide content then may be calculated from the calibration curve.

TABLE 1

| Element | Wavelength (analysis line) | Spectral Crystal |
|---|---|---|
| Ag | 4.154Å (Ag-$L_{\alpha 1}$) | PET(*1) |
| I | 3.149Å (I-$L_{\alpha 1}$) | PET(*1) |
| Br | 8.375Å (Br-$L_{\alpha 1}$) | RAP(*2) |

(*1)Pentaerythritol
(*2)Rubidium Phthalate

The silver iodobromide emulsion of this invention can be formed by first forming silver iodobromide grains as the core and then coating the core with silver iodobromide or silver bromide.

In order to make the silver iodide content distribution of individual grains of the silver halide emulsion as uniform as possible, it is necessary to keep the size and the crystal habit of the silver halide grains which become the core, and the silver halide content of individual grains in the core as completely uniform as possible. For this purpose, an aqueous solution of silver nitrate is added to an aqueous solution of a mixture of an alkali metal iodide and an alkali metal bromide in the presence of a protective colloid by a double jet method as described in, for example, U.S. Pat. No. 4,150,994 and U.K. Pat. Nos. 1,337,607 and 1,335,925. In order to narrowing the differences in silver iodide content among grains, it is particularly important that pAg during the addition of the foregoing solution is maintained constant in the range of about 7.0 to 10.0, and preferably about 8.0 to 9.0 as described in, for example, U.S. Pat. No. 4,063,951. Furthermore, the supersaturation of the solutions during the addition thereof should be as high as possible and it is effective to the solutions while increasing the density of the addition solutions so that the growing rate of the crystals becomes about 30 to 100% of the crystal growing rate of the crystal as described in, for example, U.S. Pat. No. 4,242,445. Also, it is preferred that the addition of the solutions be performed in the presence of a proper amount of a silver halide solvent such as ammonia, a thiocyanate, or a thioether compound as described in, for example, U.S. Pat. Nos. 3,790,387, 3,574,628 and 4,046,576 and U.K. Pat. No. 1,413,748.

For forming the silver iodobromide emulsion grains of this invention, it is necessary to coat the core formed by the foregoing method with silver bromide or silver iodobromide as homogeneously as possible. For this purpose, an aqueous solution of silver nitrate and an aqueous solution of an alkali halide or alkali halides are added to the emulsion containing the core grains by a double jet method while maintaining the pAg at a constant value in the range of about 6.0 to 10.0.

To obtain a particularly uniform coating, it is preferred to add the solution at relatively high supersaturation so that the growing rate of the crystals becomes about 30 to 100% of the critical growing rate of the crystals. By this method, a silver halide emulsion having a narrow silver halide content distribution between grains is obtained.

In this invention, the formation of silver halide grains or the physical ripening of silver halide grains may be performed in the presence of a cadmium salt, a zinc salt, a lead salt, a thallium salt, an iridium salt or complex salt thereof, a rhodium salt or complex salt thereof, or an iron salt or complex salt thereof in an amount of $10^{-8}$ to $10^{-3}$ mol/AgX.

One of the features of this invention is that the siler iodide content of the core portion is at least about 5 mole%, but it is preferred that the silver iodide content of the whole grain is from about 2.5 to 25 mol% and more preferably 5.0 to 20 mol%.

The silver halide emulsions of this invention are chemically sensitized. The chemical sensitization can be performed by the method described in, for example, H. Frieser (ed), *Die Grundlagen der Photographischen Prozesse mit Silberhalogeniden,* 675–734 (Akademische Verlagsgesellschaft 1968).

That is, a sulfur sensitization method using a sulfur-containing compound capable of reacting with active gelatin and silver (e.g., a thiosulfate, a thiourea, a mercapto compound or a rhodanine); a reduction sensitization method using a reducing material (e.g, a stannous salt, an amine, a hydrazine derivative, formamidinesulfinic acid or a silane compound); or a noble metal sensitization method using a noble metal compound (e.g., a gold complex salt, complex salts of metals belonging to group VIII of the periodic table, such as Pt, Ir or Pd) can be used alone or in combination.

Practical examples of chemical sensitization methods which can be used in this invention are described in, for example, U.S. Pat. Nos. 1,574,944, 2,410,689, 2,278,947, 2,728,668 and 3,656,955; of the sulfur sensitization method, in, for example, U.S. Pat. Nos. 2,983,609, 2,419,974 and 4,054,458; and of the reduction sensitizatio method in, for example, U.S. Pat. Nos. 2,399,083 and 2,448,060 and U.K. Pat. No. 618,061.

As a protective colloid for use in the preparation of the silver halide emulsions of this invention and as a binder for other hydrophilic colloid layers, gelatin is advantageously used but other hydrophilic colloids may be used, such as, for example, gelatin derivatives; graft polymers of gelatin and other polymers; proteins such as albumin and casein; cellulose derivatives such as hydroxyethyl cellulose, carboxymethyl cellulose and cellulose fulfuric acid esters; sugar derivatives such as sodium alginate and starch derivatives; and various synthetic hydrophilic polymers or copolymers such as polyvinyl alcohol, partial acetal of polyvinyl alcohol, poly-N-vinylpyrrolidone, polyacrylic acid, polymethacrylic acid, polyacrylamide, polyvinyl imidazole and polyvinyl pyrazole.

As gelatin, lime-processed gelatin as well as acid-processed gelatin, and enzyme-processed gelatin as described in *Bull. Soc. Sci. Phot. Japan,* No. 16, page 30 (1966) may be used, as well as the hydrolyzed products and enzyme-decomposition products of gelatin.

To the silver halide photographic emulsions of this invention can be added various compounds for stabilizing the photographic properties of the emulsions and preventing the formation of fog during the production, storage, or processing of the photographic materials containing the silver halide emulsions. Examples of antifoggants and stabilizers include benzothiazolium salts; nitroimidazoles; nitrobenzimidazoles; chlorobenzimidazoles; bromobenzimidazoles, mercaptothiazoles; mercaptobenzothiazoles; mercaptobenzimidazoles; mercaptothiadiazoles; aminotriazoles; benzotriazoles; nitrobenzotriazoles; mercaptotetrazoles (in particular, 1-phenyl-5-mercaptotetrazole); mercaptopyrimidines; mercaptotriazines; thioketo compounds such as oxazolinethione; azaindenes such as triazaindenes, tetraazaindenes (in particular, 4-hydroxy-substituted (1,3,3a,7)tetraazaindenes), pentaazaindens; benzenethiosulfonic acid; benzenesulfinic acid; benzenesulfonic acid amide. They are described in, for example, U.S. Pat. Nos. 3,954,474 and 3,982,947 and Japanese Patent Publication No. 28660/77.

The silver halide photographic emulsions of this invention may further contain polyalkylene oxides or the derivatives thereof, such as the ethers, esters, amines, thereof; thioether compounds; thiomorpholines; quaternary ammonium salt compounds; urethane derivatives, urea derivatives; imidazole derivatives; and 3-pyrazolidone derivatives for increasing sensitivity and contrast or for accelerating the development of the photographic materials containing the silver halide emulsions. These compounds are described in, for example, U.S. Pat. Nos. 2,400,532, 2,423,549, 2,716,062, 3,617,280, 3,772,021 and 3,808,003 and U.K. Pat. No. 1,488,991.

The silver halide photographic emulsions of this invention may be spectrally sensitized by methine dyes, including cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes, and complex merocyanine dyes. For these dyes, conventional cyanine dye nuclei such as basic heterocyclic nuclei can be used, including a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; the foregoing nuclei having fused thereto aliphatic hydrocarbon rings; and the foregoing nuclei having fused thereto aromatic hyrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may be further substituted at the carbon atoms.

A 5- or 6-membered heterocyclic nucleus having a ketomethylene structure such as a pyrazolin-5-one nucleus, a thiohydantoin nucleus, a 2-thiooxazolidine-2,4-dione nucleus, a thiazolidine-2,4-dione nucleus, rhodanine nucleus or thiobarbituric acid nucleus can be used as a nucleus for the merocyanine dyes or complex merocyanine dyes.

These sensitizing dyes may be used alone or in combination, and a combination of sensitizing dyes is frequently used for supersensitization.

Practical examples of these dyes are described in, for example, U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707; U.K. Pat. Nos. 1,344,281 and 1,507,803; Japanese Patent Publication Nos. 4936/78 and 12375/87; and Japanese Patent Application (OPI) Nos. 110618/77 and 109925/77.

The silver halide photographic emulsions of this invention may further contain dyes having a spectral sensitizing action or materials which do not substantially absorb visible light but which exhibit a supersensitizing effect when used together with the foregoing sensitizing dyes.

The photographic materials using the silver halide emulsions of this invention may contain water-soluble dyes as filter dyes or for various purposes such as irradiation prevention, in the hydrophilic colloid layers thereof. Examples of such dyes are oxonol dyes, hemioxonol dyes, styryl dyes, merocyanine dyes, cyanine dyes, and azo dyes. Among these dyes, oxonol dyes, hemioxonol dyes and merocyanine dyes are useful.

The photographic materials containing the silver halide emulsions of this invention may contain stilbene series, triazine series, oxazole series, or cumarine series whitening agents in the silver halide emulsion layers and other hydrophilic colloid layers. These materials may be water soluble or water insoluble and in the latter case, they may be used as dispersions.

Known fading preventing agents may be used along with color image stabilizers in this invention, alone or in combination.

Examples of the fading preventing agents include the hydroquinone described in, for example, U.S. Pat. Nos. 2,360,290, 2,418,613, 2,675,314, 2,701,197, 2,704,713, 2,728,659, 2,732,300, 2,735,765, 2,710,801 and 2,816,028, and U.K. Pat. No. 1,363,921; the gallic acid derivatives described in, for example, U.S. Pat. Nos. 3,457,079 and 3,069,262; the p-alkoxyphenols described in U.S. Pat. Nos. 2,735,765 and 3,698,909, Japanese Patent Publication Nos. 20977/74 and 6623/77; the p-oxyphenol derivatives described in U.S. Pat. Nos. 3,432,300, 3,573,050, 3,574,627, 3,764,337, Japanese Patent Application (OPI) Nos. 35633/77, 147,434/77 and 152225/77; and the bisphenol derivatives described in U.S. Pat. No. 3,700,455.

The photographic materials using the silver halide emulsions of this invention may further contain hydroquinone derivatives, aminophenol derivatives, gallic acid derivatives and ascorbic acid derivatives, as color fogging preventing agents.

The silver halide photographic emulsions of this invention can be used for both black and white photographic materials and multilayer multicolor photographic materials and are particularly preferably used for high-speed photographic materials.

A multilayer natural color photographic material ordinarily has at least one red-sensitive silver halide emulsion layer, at least one green-sensitive emulsion layer and at least one blue-sensitive silver halide emulsion layer on a support. The red-sensitive emulsion layer usually contains a cyan dye-forming coupler, the green-sensitive emulsion layer contains a magenta dye-forming coupler, and the blue-sensitive emulsion layer contains a yellow dye-forming coupler, but if desired, other combinations may be employed.

As the yellow coloring couplers, known closed chain ketomethylenic couplers can be used, including benzoylacetoanilide series compound and pivaloylacetoanilide series compounds. Practical examples of the yellow coloring couplers for use in this invention are described in U.S. Pat. Nos. 2,875,057, 3,265,506, 3,408,194, 3,551,155, 3,582,322, 3,725,072 and 3,891,445, West German Pat. No. 1,547,868, West German Patent Publication (OLS) Nos. 2,219,917, 2,261,361, and 2,414,006, U.K. Pat. No. 1,425,020, Japanese Patent Publication No. 10783/76, Japanese Patent Application (OPI) Nos. 26,133/72, 73,147/73, 102,636/73, 6341/75, 123,342/75, 130442/75, 21827/76, 87650/75, 82424/77 and 115219/77.

As magenta coloring couplers, pyrazolone series compounds, indazolone series compounds and cyanoacetyl compounds can be used and pyrazolone series compounds are particularly useful. Practical examples of the magenta coloring couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Patent No. 1,810,464, West German Patent Publication (OLS) Nos. 2,408,665, 2,417,945, 2,418,959, 2,424,467, Japanese Patent Publication No. 6301/65, and Japanese Patent Application (OPI) Nos. 20826/76, 58922/77, 129538/74, 74027/74, 159336/75, 42121/77, 74028/74, 60233/77, 26541/76 and 55122/78.

As cyan coloring couplers, phenolic compounds and naphtholic compounds can be used, including those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Publication (OLS) Nos. 2,414,830 and 2,454,329, Japanese Patent Application (OPI) Nos. 59838/73, 26034/76, 5055/73, 146828/76, 69624/77, and 90932/77.

As cyan coloring couplers, couplers having a ureido group as described in Japanese Paent Application (OPI) Nos. 204545/82, 65134/81, 33252/83 and 33249/83 can be preferably used.

Colored couplers can be also used in the photographic materials using the silver halide emulsions of this invention, including those described in, for example, U.S. Pat. Nos. 3,476,560, 2,521,908 and 3,034,892, Japanese Patent Publication Nos. 2016/69, 22335/63, 11304/67 and 32,461/69, Japanese Patent Application (OPI) Nos. 26034/76, 42121/77 and West German Patent Publication (OLS) No. 2,418,959.

DIR couplers (development inhibitor releasing couplers) can be used in this invention and they are described in, for example, U.S. Pat. Nos. 3,227,554, 3,617,291, 3,701,783, 3,790,384 and 3,632,345, West German Patent Publication (OLS) Nos. 2,414,006, 2,454,301, 2,454,329, U.K. Pat. No. 953,454, Japanese Patent Application (OPI) Nos. 69624/77 and 122335/74 and Japanese Patent Publication No. 16141/76.

The photographic materials using the silver halide emulsions of this invention may contain compounds capable of releasing development inhibitors (apart from DIR couplers) with the progress of the development, such as those described in, for example, U.S. Pat. Nos. 3,297,445 and 3,379,529, West German Patent Publication (OLS) Nos. 2,417,914, Japanese Patent Application (OPI) Nos. 15271/77 and 9116/78.

Also, couplers capable of releasing development accelerators or fogging agents with the process of development as described in Japanese Patent Application (OPI) No. 150845/82 can be preferably used in this invention.

These couplers are incorporated in the silver halide emulsions in an amount of about $2\times10^{--3}$ mol to $5\times10^{-1}$ mol, preferably about $1\times10^{-2}$ mole to $5\times10^{-1}$ mol.

The photographic materials containing the silver halide emulsions of this invention may contain ultraviolet absorbents in the hydrophilic colloid layers, such as aryl group-substituted benzotriazole compounds described in, for example, U.S. Pat. No. 3,533,794; 4-thiazolidone compounds described in U.S. Pat. Nos. 3,314,794 and 3,352,681; benzophenone compounds described in Japanese Patent Application (OPI) No. 2784/71, cinnamic acid ester compounds described in U.S. Pat. Nos. 3,705,805 and 3,707,375, butadiene compounds described in U.S. Pat. No. 4,045,229, and benzoxydol compounds described in U.S. Pat. No. 3,700,455. In addition, the ultraviolet absorbents described in U.S. Pat. No. 3,499,762 and Japanese Patent Application (OPI) No. 48535/79 can be used in this invention. Still further, ultraviolet absorbing couplers (e.g., α-naphtholic cyan dye-forming couplers) and ultraviolet absorbing polymers may be used in this invention. These ultraviolet absorbents may e mordanted in specific layers of the photographic materials.

For processing the photographic materials containing the silver halide emulsions of this invention, known processes and known processing solutions can be used. The processing temperatures are usually in the range of about 18° C. to 50° C. but may be lower than 18° C. or higher than 50° C. According to the purposes, a development process forming silver image (black and white development process) or color photographic process composed of development process for forming dye images can be used for developing the photographic materials.

The color developer which is used for developing the photographic materials in this invention is generally composed of an alkaline aqueous solution containing a color developing agent. Color developing agent include aromatic primary amino color developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline and 4-amino-3-methyl-N-ethyl-N-β-methoxyethylaniline).

The silver halide photographic emulsion layers are usually bleached after color development. The bleach process may be performed simultaneously with fix process or separately from the fix process. Bleaching agents include compounds of multivalent metals such as iron(III), cobalt(III), chromium(VI) and copper(II); peracids; quinones and nitroso compounds such as ferricyanides; dichromates; organic complex salts if iron(III) or cobalt(III); aminopolycarboxylic acids such as ethylenediaminetetraacetic acid, nitrotriacetic acid and 1,3-diamino-2-propanoltetraacetic acid; complex salts of organic acids such as citric acid, tartaric acid and malic acid; persulfates; permanganates and nitrosophenol. Among these materials, potassium ferricyanide, ethylenediaminetetraacetic acid iron(III) sodium salt and ethylenediaminetetraacetic acid iron(III) ammonium salt are particularly useful. The ethylenediaminetetraacetic acid iron(III) complex salts are useful for a bleach solution and for a blix solution.

The invention is explained in more detail with reference to the following examples, but the invention is not limited to these examples. Unless otherwise indicated, all parts, percents and ratios are by weight.

EXAMPLE 1

In a four liter stainless steel reaction vessel were placed 60 g of gelatin and 900 ml of water and while maintaining the mixture at 60° C., an aqueous solution of silver nitrate and an aqueous solution of a mixture of potassium bromide and potassium iodide were added continuously to the mixture in equivalent amounts, to prepare a silver iodobromide emulsion as the core. Afterward the core was coated with silver bromide by continuously adding to the solution an aqueous solution of silver nitrate and an aqueous solution of potassium bromide in equivalent amounts, to produce a core/shell type silver iodobromide emulsion.

The time when each solution was added and the concentrations of the solutions are shown in Table 2.

TABLE 2

| | Aqueous Silver Nitrate Solution | | Aqueous Potassium Halide Solution | | | |
|---|---|---|---|---|---|---|
| Time (min.) | $AgNO_3$ (gram) | Volume (ml) | KBr (gram) | KI (gram) | Volume (ml) | Stirring Speed (r.p.m.) |
| 0 to 10 | 0.32 | 120 | 0.20 | 0.031 | 120 | 750 |
| 10 to 30 | 2.55 | 240 | 1.61 | 0.25 | 240 | " |
| 30 to 50 | 20.4 | 240 | 12.9 | 1.99 | 240 | " |
| 50 to 70 | 81.6 | 240 | 51.4 | 7.97 | 240 | 1,000 |
| 70 to 90 | 122.3 | 240 | 77.1 | 12.0 | 240 | " |
| 90 to 110 | 227.2 | 240 | 159.1 | 0 | 240 | " |

During the addition of the solutions, the pAg of the system was kept at 8.6 for the first 10 minutes, 8. for the subsequent 80 minutes, and 7.3 for the final 20 minutes.

The silver iodobromide emulsion thus obtained was designated EM-1.

EXAMPLE 2

Following the same procedure as in Example 1, a core/shell type silver iodobromide emulsion was prepared. In this example, however, the pAg of the system was kept at 8.6 for the first 10 minutes, 7.03 for the subsequent 80 minutes, and 7.3 for the final 20 minutes.

The silver iodobromide emulsion thus obtained was designated EM-2.

Comparison Example

A core/shell type silver iodobromide emulsion was prepared in the same manner as in Example 1. In this case, however, the pAg of the system during the addition of solutions was kept at 8.6 for the first 10 minutes, 6.5 for the subsequent 80 minutes, and at 7.3 for the final 20 minutes.

The silver iodobromide emulsion thus obtained was designated EM-3.

Figure 2:
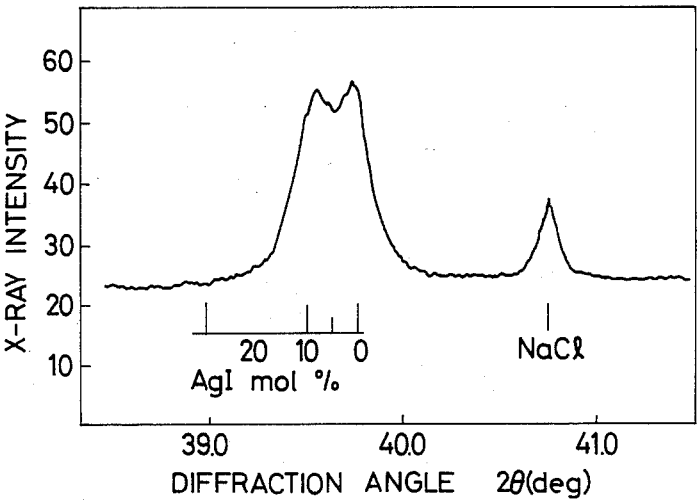
FIG. 2 is a graph showing the X-ray diffraction peak profile of the silver halide emulsion, EM-1 in the example.
Figure 3:
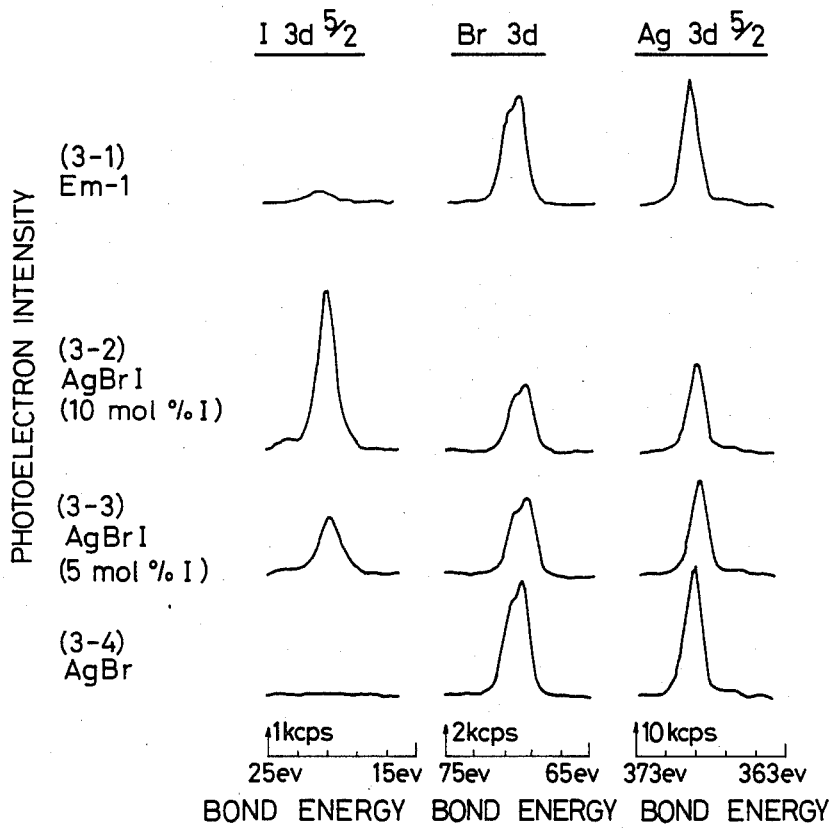
FIG. 3 shows the peak profiles of iodine, bromine, and silver in the surface composition analysis of silver halide grains by an X-ray photoelectric spectrograph.

Each of the silver halide emulsion EM-1, EM-2 and EM-3 had core composed of silver iodobromide containing about 10 mole% silve iodide and a shell composed of silver bromide. This was confirmed by a powder X-ray diffraction analysis and an X-ray analysis of EM-1 disclosed two peaks as shown in FIG. 2, in which the x-axis shows the diffraction angle (2θ) and the y-axis shows the diffraction X-ray intensity. A surface composition analysis of EM-1 by an X-ray photoelectric spectrum resembled silver bromide as shown in FIG. 3, wherein FIG. 3-1 illustrates the peak profile of EM-1, FIG. 3-2 illustrates the peak profile of AgBrI (I=10 mol%) of homogeneous structure, FIG. 3-3 illustrates the peak profile of AgBrI (I=5 mol%) of homogeneous structure, and FIG. 3-4 illustrates the peak profile of AgBr grains. In FIG. 3, the x-axis shows the bond energy of the photoelectrons and the y-axis shows the intensity of photoelectrons.

Furthermore, the grain sizes and grain size distribution of each of the emulsions EM-1, EM-2 and EM-3 were measured using a coal tar counter and the distribution of the silver iodide content between silver halide grains was also measured for each emulsion using X-ray microanalyzer. The results obtained by the examination of 100 grains are shown in Table 3. As is clear from the results, the grain size and the grain size distribution almost the same in emulsions EM-1, EM-2 and EM-3 but the silver iodide content distribution between grains became broader in the order of EM-1, EM-2 and EM-3, i.e., it was broadest in EM-3.

TABLE 3

| Silver Halide Emulsion | Grain Size (μm) | Grain Size Distribution(*) (%) | Mean AgI Content (Formula value) (mole %) | Relative Standard Deviation of AgI Content(**) (%) |
|---|---|---|---|---|
| EM-1 | 0.6 | 15 | 5 | 11 |
| EM-2 | 0.6 | 16 | 5 | 18 |
| EM-3 | 0.6 | 13 | 5 | 36 |

(*)Grain size distribution = (standard deviation of grain size)/(mean value of grain size) × 100
(**)Relative standard deviation of AgI content = (standard deviation of AgI content of each grain)/(mean AgI content) × 100
EM-1 and EM-2 are the samples of this invention and EM-3 is a comparison sample.

Each of the emulsions EM-1, EM-2 and EM-3 was desalted by an ordinary manner, washed with water, and after adjusting the pH to 6.5 and 9.0 and the pAg at 63° C., was chemically ripened for 60 minutes at 63° C. with the addition of 3.5 ml of an aqueous solution of 0.1% chloroauric acid and 6.8 ml of an aqueous solution of 0.1% sodium thiosulfate per mol of the silver halide of each emulsion. Thereafter, the silver halide emulsion layer and the protective layer shown below were coated on a triacetyl cellulose film having a subbing layer.

Silver halide emulsion layer:

Silver halide emulsion:

EM-1, 2 or 3 shown in Table 3 (silver $2.1\times10^{-2}$ mol/m$^2$)

Coupler having the following formula:

($1.5\times10^{-3}$ mol/m$^2$)

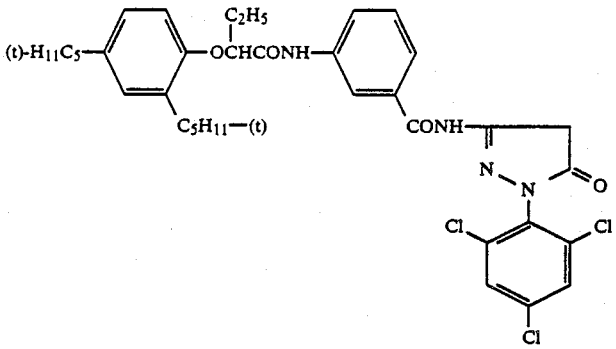

Tricresyl phosphate: (1.10 g/m$^2$)

Gelatin: (2.30 g/m$^2$).

Protective layer:

2,4-Dichlorotriazine-6-hydroxy-s-triazine sodium salt: (0.08 g/m$^2$)

Gelatin: (1.80 g/m$^2$)

After allowing each sample thus obtained to stand for 14 hours at 40° C. and 70% relative humidity, each sample was exposed for sensitometry and then subjected to the following color development process.

The density of the sample thus processed was measured using a green filter.

The development process was as follows and performed at 38° C.

| | |
|---|---|
| 1. Color development | 2 min. 45 sec. |
| 2. Bleach | 6 min. 30 sec. |
| 3. Wash | 3 min. 15 sec. |
| 4. Fix | 6 min. 30 sec. |
| 5. Wash | 3 min. 15 sec. |
| 6. Stabilization | 3 min. 15 sec. |

The compositions of the processing liquids used for the foregoing processings were as follows.

Color developer:

| | |
|---|---|
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethyl-amino)-2-methylaniline sulfate | 4.5 g |
| Water to make | 1 liter |

Bleach solution:

| | |
|---|---|
| Ammonium bromide | 160.0 g |
| Aqueous ammonia (28%) | 25.0 ml |
| Ethylenediaminetetraacetic acid sodium iron salt | 130 g |
| Glacial acetic acid | 14 ml |
| Water to make | 1 liter |

Fix solution:

| | |
|---|---|
| Sodium tetrapolyphosphate | 2.0 g |
| Sodium sulfite | 4.0 g |
| Ammonium thiosulfate (70%) | 175.0 ml |
| Sodium hydrogensulfite | 4.6 g |
| Water to make | 1 liter |

Stabilizer:

| | |
|---|---|
| Formaldehyde | 8.0 ml |
| Water to make | 1 liter |

The results of the sensitometry and the measurement of granularity are shown in Table 5.

TABLE 5

| Sample Number | Emulsion | Sensitivity | Fog | Gamma(*) | RMS Granularity(**) |
|---|---|---|---|---|---|
| 1 | EM-1 | 100 | 0.15 | 1.73 | 0.018 |
| 2 | EM-2 | 99 | 0.14 | 1.65 | 0.023 |
| 3 | EM-3 | 90 | 0.15 | 1.44 | 0.030 |

(*)The density difference between the density of (fog + 0.2) and the density produced by an exposure 10 times higher than that producting (fog + 0.2)
(**)The RMS value exposing the sample at an exposure producing a density of 2.0 and measuring the density of the processed sample using an aperture of 48 μm in diameter.

As is clear from the results shown in Table 5, the silver halide emulsions of this invention are excellent in gradation and graininess as compared to the comparison sample.

While the present invention has been described in detail and with reference to specific embodiments thereof, it will be apparent to one skilled in the art that various changes and modifications can be made therein without departing from the spirit and scope thereof.

What is claimed is:

1. A light-sensitive silver iodobromide emulsion containing core/shell silver iodobromide grains having a core substantially comprising silver iodobromide containing at least about 5 mol% of silver iodide and a shell selected from the group consisting of (a) a shell comprising silver iodobromide having a lower silver iodide content than that of the silver iodobromide of the core and (b) a shell comprising silver bromide, wherein the relative standard deviation of the silver iodide content of the individual grains of said silver halide emulsion is lower than about 20%, and wherein at least about 95% (by number) of the grains have a size within about ±40% of the mean grain size.

2. The light-sensitive silver halide emulsion claimed in claim 1, wherein the silver iodide content of the core is from about 5 to 45 mol%.

3. The light-sensitive silver halide emulsion claimed in claim 1, wherein the silver iodide content of the core is from about 10 to 45 mol%.

4. The light-sensitive silver halide emulsion claimed in claim 1, wherein the silver iodide content of the shell is less than 5 mol%.

5. The light-sensitive silver halide emulsion claimed in claim 1, wherein the shell comprises of silver bromide.

6. The light-sensitive silver halide emulsion claimed in claim 1, wherein the core of said silver iodobromide grains comprises an inner portion substantially comprising silver iodobromide having a silver iodide content of less than about 5 mol%, and at least one outer layer comprising silver iodobromide having a silver iodide content of from about 5 to 45 mol% formed on the inner portion, and said shell comprises silver iodobromide having a silver iodide content of less than about 5 mol% or said shell comprises silver bromide.

7. The light-sensitive silver halide emulsion claimed in claim 1, wherein the core is formed by a double jet method at a constant pAg controlled in the range of about 7.0 to 10.0.

8. The light-sensitive silver halide emulsion claimed in claim 1, wherein the core is formed by a double jet method at a constant pAg controlled in the range of about 8.0 to 9.0.

9. The light-sensitive silver halide emulsion claimed in claim 7, wherein the core is formed by adding an aqueous silver nitrate solution and an aqueous halide solution such that the growing rate of the core is from about 30 to 100% of the critical growing rate of the silver halide crystal forming the core.

10. The light-sensitive silver halide emulsion claimed in claim 7, wherein the core grain is formed in the presence of a silver halide solvent.

11. The light-sensitive silver halide emulsion claimed in claim 7, wherein the shell is formed by simultaneously adding an aqueous silver nitrate solution and an aqueous halide solution to the silver halide emulsion containing core grains while controlling the pAg at a constant value in the range of about 6.0 to 10.0.

12. The light-sensitive silver halide emulsion claimed in claim 11, wherein the shell is formed by adding an aqueous silver nitrate solution and an aqueous halide solution such that the growing rate of the shell is from about 30 to 100% of the critical growing rate of the silver halide crystal forming the shell.

13. The light-sensitive silver halide emulsion claimed in claim 1, wherein the relative standard deviation of the iodide content of individual grains is less than about 12%.

14. The light-sensitive silver halide emulsion claimed in claim 9, wherein the addition rates of the aqueous silver nitrate solution and the aqueous halide solution are increased with the growth of the silver halide crystals.

15. The light-sensitive silver halide emulsion claimed in claim 9, wherein the concentrations of the aqueous silver nitrate solution and the aqueous halide solution are increased with the growth of the silver halide crystals.

* * * * *